US005358034A

United States Patent [19]

Nishishita et al.

[11] Patent Number: 5,358,034

[45] Date of Patent: Oct. 25, 1994

[54] HEAT EXCHANGER

[75] Inventors: Kunihiko Nishishita; Tadaaki Ishikawa; Yasuyuki Nagakura; Takashi Sugita, all of Konan, Japan

[73] Assignee: Zexel Corporation, Tokyo, Japan

[21] Appl. No.: 125,309

[22] Filed: Sep. 23, 1993

[30] Foreign Application Priority Data

| | | | |
|---|---|---|---|
| Sep. 25, 1992 | [JP] | Japan | 4-072942[U] |
| Nov. 27, 1992 | [JP] | Japan | 4-087664[U] |
| Apr. 2, 1993 | [JP] | Japan | 5-022159[U] |
| Apr. 30, 1993 | [JP] | Japan | 5-028639[U] |

[51] Int. Cl.[5] ..... F78D 1/03

[52] U.S. Cl. ..... 165/153; 165/178; 165/906; 285/287

[58] Field of Search ..... 165/153, 178, 906; 285/287

[56] References Cited

U.S. PATENT DOCUMENTS

| | | | |
|---|---|---|---|
| 4,649,894 | 3/1987 | Hoefflien | 165/178 X |
| 4,860,823 | 8/1989 | Noguchi | 165/153 |

*Primary Examiner*—John C. Fox

*Attorney, Agent, or Firm*—Wenderoth, Lind & Ponack

[57] ABSTRACT

A heat-exchanger includes a plurality of stacked tubular elements each having tanks, and passage-forming protrusions defining a passage connecting the tanks, fins interposed between adjacent ones of the tubular elements and contacting the passage-forming protrusions, inlet/outlet units each comprising a barrel-shaped element protruding from and open to the tank of a respective one of the tubular elements, inlet/outlet pipes fitted coaxially in contact with and joined to the barrel-shaped elements, respectively, and a measure (reinforcement) for preventing parts of the barrel-shaped elements from being deformed as the inlet/outlet pipes are fitted to the barrel-shaped elements during the assembly of the heat exchanger to in turn maintain the integrity of the joints between the inlet/outlet units and the inlet/outlet pipes. The reinforcement may include a ring disposed around the barrel-shaped element adjacent an end thereof. When the inlet/outlet pipe is fitted into and in contact with the barrel-shaped element, the ring prevents the parts of the barrel-shaped element from being forced outwardly. The reinforcement may also include, in an addition or as an alternative to the ring, at least one protrusion extending from the parts of the barrel-shaped element and contacting the inlet/outlet pipe fitted to the barrel-shaped element. The at least one protrusion prevents the inlet/outlet pipe from being moved too far axially relative to the barrel-shaped element thereby ensuring that the inlet/outlet pipe does not deform the parts of the barrel-shaped element.

14 Claims, 12 Drawing Sheets

HEAT EXCHANGER

BACKGROUND OF THE INVENTION

1. Field of the Invention

The present invention pertains to a heat exchanger primarily used for an automobile air conditioner.

2. Description of the Related Art

In the past, a heat exchanger, e.g. the one disclosed in Japanese Kokai Patent Utility Model Publication No. 63-154985, included, as shown in FIG. 17 and FIG. 18, a tubular element 1*b* having an inlet/outlet unit 3 comprising a barrel-shaped element 17 formed of integral parts of two molded plates of the tubular element 1*b*. The inlet/outlet unit 3 protrudes from a tank 18 of the tubular element 1*b*. The tubular element 1*b* is formed by soldering the two molded plates together along a seam 16 running therebetween after a spacer 6 has been inserted in an insertion hole 25 of the inlet/outlet unit 3.

In the method of attaching an inlet/outlet pipe 5 to the spacer 6, in the aforementioned prior art, the inlet/-outlet pipe 5 is inserted into the spacer 6 and secured to it by means of argon soldering or torch blazing.

In the aforementioned prior art, however, there is a problem that the joint of the inlet/outlet unit 3 was expanded outwardly when the spacer 6 was pushed into the inlet/outlet unit 3, causing a large gap between the joint unit and spacer 6, whereby the soldering resulted in a defect in the joint between said inlet/outlet unit 3 and spacer 6, allowing the heat-exchanging medium to leak.

There has been a demand that the spacer be eliminated to reduce the cost for a heat exchanger. However, if the inlet/outlet pipe 5 is directly secured to inlet/outlet unit 3 due to the absence of spacer 6, torch blazing must be used. In this case, however, a problem arises in that since the plates at the inlet/outlet unit 3 are as thin as approximately 0.6 mm, the inlet/outlet unit 3 would be melted if directly contacted by a flame during torch blazing, thereby damaging the inlet/outlet unit 3 and creating a defective sealing of the inlet/outlet unit. There also is an apprehension that the inlet/outlet unit will lack rigidity and that the positioning of the inlet/-outlet pipe will become difficult.

In addition, Japanese Kokai Patent Utility Model Publication No. H4-129691, which was filed by the same applicant who has filed the application of the present invention, predating the application of the present invention, discloses a structure wherein the soldering seam terminates prior to the end of the inlet/outlet unit, a ring is placed on the inlet/outlet unit at the end thereof, and a spacer is attached to the inlet/outlet unit. The inlet/outlet pipe is secured to the heat exchanger by means of this spacer.

SUMMARY OF THE INVENTION

The primary object of the present invention is to provide a heat exchanger which does not have a spacer at its inlet/outlet unit.

To achieve this object, the present invention provides a heat exchanger comprising: a stack of tubular elements, each of which is made by joining two molded plates along a soldering seam by butt fusion, and has a pair of tanks and a passage connecting the tanks, the tanks of the tubular elements being aligned in rows in the direction in which the tubular elements are stacked; fins interposed between the stacked tubular elements and contacting portions of the molded plates forming the passages; an inlet/outlet unit, which is to receive an inlet/outlet pipe and includes a barrel-shaped element protruding from the tank of a tubular element; and reinforcing means for preventing parts of the barrel-shaped element from being deformed when the inlet/outlet pipe is fitted thereto during assembly of the heat exchanger.

The soldering seam may be spaced a prescribed distance from the end of the barrel-shaped element. In this case, the reinforcing means is a ring disposed adjacent the end of the barrel-shaped element of the inlet/outlet unit.

Because the ring is fitted around the portion of the barrel-shaped element where there is no soldering seam, the ring prevents the inlet/outlet unit from being deformed by the force when the inlet/outlet pipe is fitted to the barrel-shaped element from the inside thereof. Therefore, the circular form of the inlet/outlet unit can be preserved without a spacer. Since the inlet/outlet pipe is secured, no gap is created between the inlet/outlet unit and the inlet/outlet pipe. When the inlet/outlet pipe and the inlet/outlet unit are secured by torch blazing, the heat from the torch blazing is absorbed by the ring mounted on the end of the inlet/outlet unit, so that the inlet/outlet unit is prevented from being melted.

The thickness of the ring in its axial direction may be equal to the prescribed length over which the soldering seam is spaced from the end of the barrel-shaped element.

Therefore, the ring is easy to position on the end of the barrel-shaped element.

Fringes of the plates forming the soldering seam extend radially outwardly from the barrel-shaped element over a distance equal to or less than the thickness of the aforementioned ring in its radial direction. Therefore, the flame when the inlet/outlet pipe is soldered to the inlet/outlet unit does not directly contact the inlet/outlet unit, whereby damage to the inlet/outlet unit can be prevented.

In addition, the barrel-shaped element may have a protrusion spaced from the end thereof by a distance that is equal to the distance over which the terminal end of the soldering seam is spaced from the end of the barrel-shaped element. The ring is brought into contact with the fringes defining the soldering seam and with the protrusion.

Thus, the ring is supported by the fringes defining the soldering seam and by the protrusion and therefore can be fixed at a desired position, without being tilted when secured to the inlet/outlet unit.

The reinforcing means can also be in the form of a protrusion(s) protruding from the barrel-shaped element and contacting the inlet/outlet pipe to prevent the pipe from being moved too far in its axial direction when it is secured to the inlet/outlet unit.

Moreover, because the inlet/outlet pipe can be inserted into or moved onto the inlet/outlet unit until it contacts the protrusion(s), the positioning of the inlet/-outlet pipe becomes easy. In addition, these protrusions on the inlet/outlet unit enhance the rigidity of (reinforce) the inlet/outlet unit.

The protrusion(s) can be formed on the inner surfaces of the parts of the barrel-shaped element, wherein the inlet/outlet pipe inserted into the inlet/outlet unit.

Alternatively, in a heat exchanger wherein the inlet/-outlet pipe is mounted on and secured to the outside of the inlet/outlet unit, the protrusions are formed on the outer surface of the inlet/outlet unit.

The protrusions may be formed at two diametrically opposing portions of the inlet/outlet unit.

Further, the protrusions may be elongate in the axial direction of the inlet/outlet pipe.

By providing protrusions which are elongate in the axial direction of the inlet/outlet pipe, the strength of the inlet/outlet unit is enhanced against the force exerted on it in the direction in which the inlet/outlet pipe is inserted into or mounted onto the inlet/outlet unit. In addition, the strength of the inlet/outlet unit is also enhanced to withstand any bending moment exerted on it by the inlet/outlet pipe.

The reinforcing means for preventing deformation of the barrel-shaped element can include both the protrusion(s) of the barrel-shaped element and the ring mounted adjacent the end of the inlet/outlet unit, with all the attendant advantages of the ring being realized.

BRIEF DESCRIPTION OF THE DRAWINGS

Further objects, features and advantages of the present invention will become apparent from the following description of preferred embodiments thereof made with reference to the accompanying drawings.

DETAILED DESCRIPTION OF THE PREFERRED EMBODIMENTS

Preferred embodiments of the present invention are described below with reference to the drawings.

Figure 1:
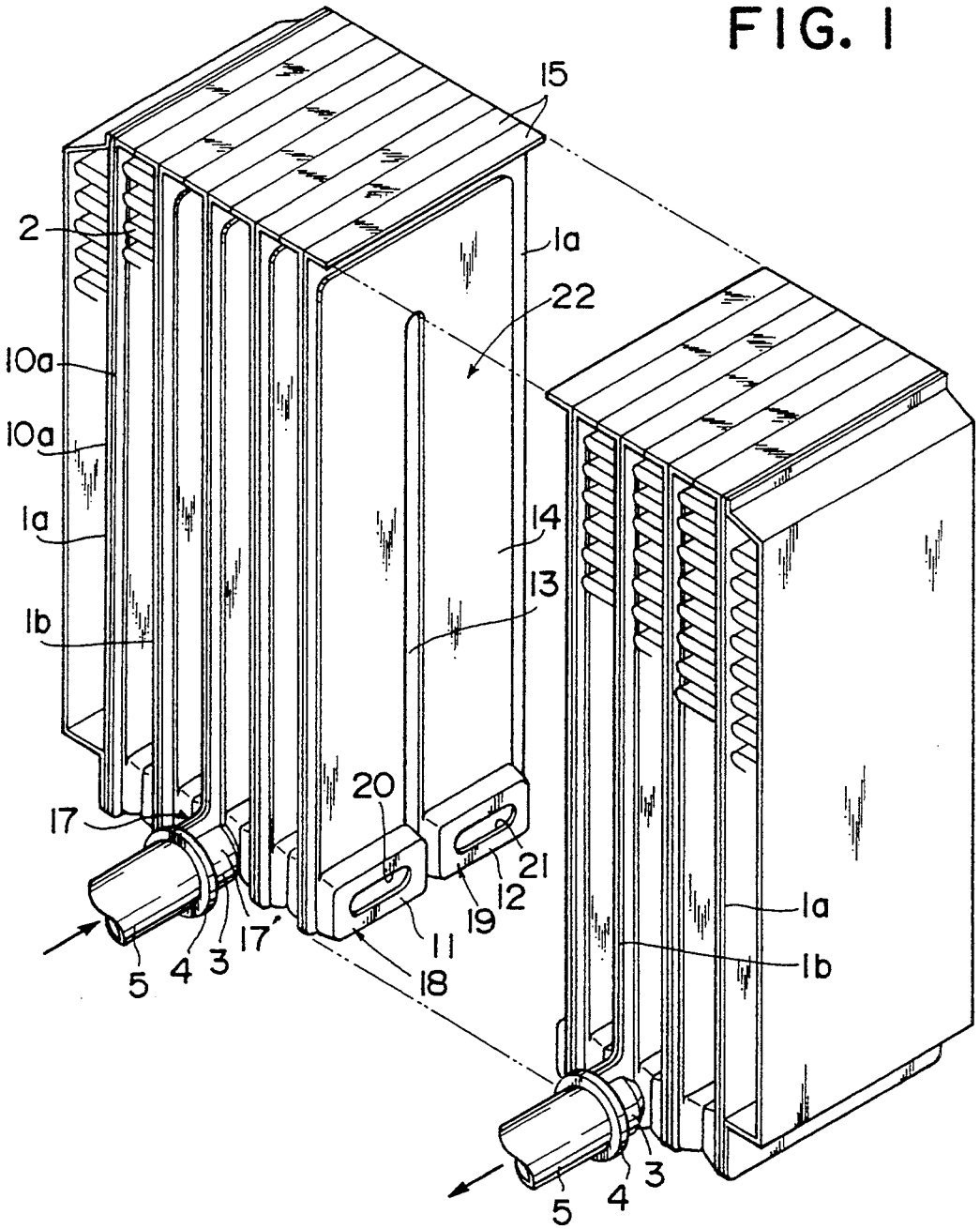
FIG. 1 is a perspective view of a first embodiment of the heat exchanger of the present invention.

The heat exchanger shown in FIG. 1 has a plurality of tubular elements including first tubular elements 1*a* and second tubular elements 1*b*. Fins 2 are stacked between the tubular elements. Inlet/outlet units 3, 3 protrude from the tubular elements 1*b*, 1*b*.

Rings 4, 4 are disposed on inlet/outlet units 3, 3. Inlet/outlet pipes 5, 5 are inserted into and secured to the inlet/outlet units 3, 3.

The first tubular elements 1*a* and second tubular elements 1*b* have rectangular interior sectional shapes and are formed of first, second, and third molded plates 10*a*, 10*b*, 10*b*′ which are described below, so as to create the interior spaces of the tubular elements. First tubular elements 1*a* are each formed by joining two plates, namely first molded plates 10*a* and 10*b* by butt fusion. Second tubular elements 1*b* are each formed of second and third molded plates 10*b* and 10*b*′.

The first, second, and third molded plates 10*a*, 10*b*, 10*b*′ are made of, e.g. aluminum or aluminum alloy, are formed by a press, and are approximately 0.6 mm thick. They have protrusions 11, 12 for forming tanks at first longitudinal ends thereof, they define strips 13 extending from between protrusions 11, 12 toward the other longitudinal ends of the plates, and they have passage-forming protrusions 14 forming nearly U-shaped passages around strips 13. The passage-forming protrusions 14 are connected to the tank-forming protrusions 11 and 12. On the second ends of the first, second, and third molded plates 10*a*, 10*b*, 10*b*′ are contact portions 15 bent outwardly from main bodies of the plates to regulate the distance between the main bodies of the tubular elements.

In addition, soldering seams 16 are located at the fringes of the first, second, and third molded plates 10*a*, 10*b*, 10*b*′.

Barrel-shaped elements, each formed of parts 17, 17′ of the molded plates, protrude from and are connected to the sides of tank-forming protrusions 11, 12 of the second and third molded plates 10*b*, 10*b*′ constituting a second tubular element 1*b*. When second and third molded plates 10*b*, 10*b*′ are joined by butt fusion parts 17 17′ of the barrel-shaped elements are also joined by butt fusion, to form an inlet/outlet unit 3. The second molded plate 10*b* and the third molded plate 10*b*′ have shapes symmetrical to each other, so that the part 17 of the barrel-shaped element of the second molded plate 10*b* and the part 17′ of the same barrel-shaped element of the third molded plate 10*b*′ will face each other when joined together to form an inlet/outlet unit 3. Pairs of tanks 18, 19 are made up of sets of the tank-forming protrusions 11, 12, respectively, and the passage-forming protrusions 14 constitute a nearly U-shaped heat-exchanging medium passage 22. Thus, the tanks 18 are connected to the tank 19 via heat-exchanging medium passages 22.

Two of the second tubular elements 1*b* are disposed at designated positions. The tanks 18 or 19 which are in contact with each other are also open to each other by means of tank through-holes 20, 21 in the tank-forming protrusions 11, 12.

The tank 18 of the tubular element, which is located in the middle of the stack of elements 1*b*, is closed to divide the stack into a right bloc and left bloc.

More specifically, in the heat exchanger of the present invention, the heat-exchanging medium flows from the inlet/outlet pipe 5 in the left bloc in the figure into the tanks 18 of the left bloc. From these tanks 18, the heat-exchanging medium flows into the heat-exchanging medium passage 22 in each of the tubular elements 1*a*, 1*b* of the left bloc and to the group of tanks 19. After the heat-exchanging medium has flowed throughout these tanks, it flows into the heat-exchanging medium passage 22 in each of the tubular elements 1*a*, 1*b* of the right bloc, and is accumulated in the tanks 18 of the right bloc from where it drains from the heat exchanger through the other inlet/outlet pipe 5. Thus, what is called a "four pass-flow pattern" is formed.

Figure 2:
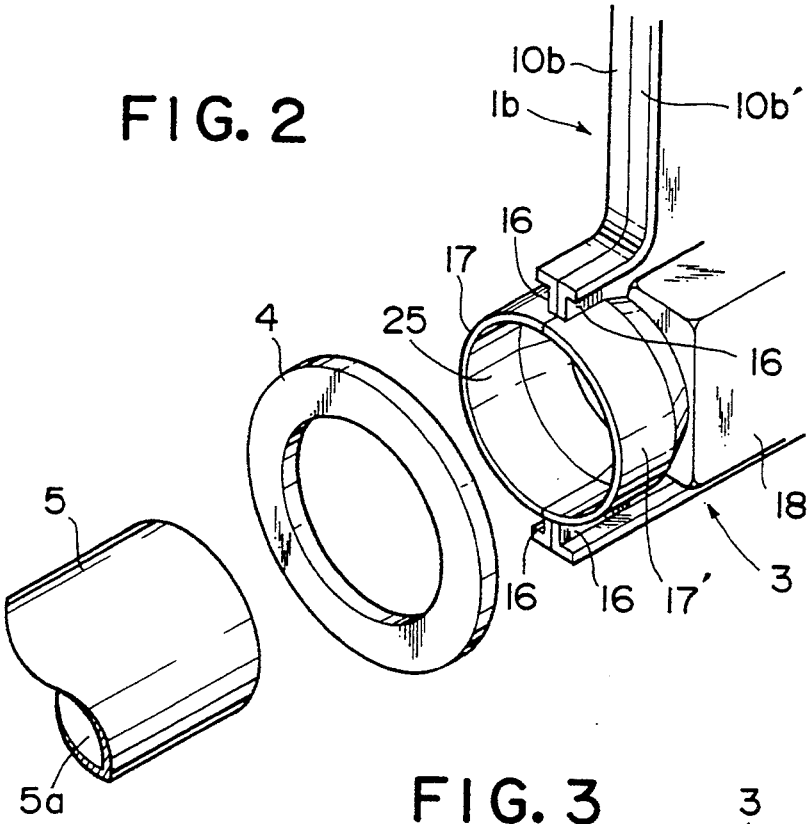
FIG. 2 is an exploded view of the inlet/outlet unit of the first embodiment of the heat exchanger.
Figure 3:
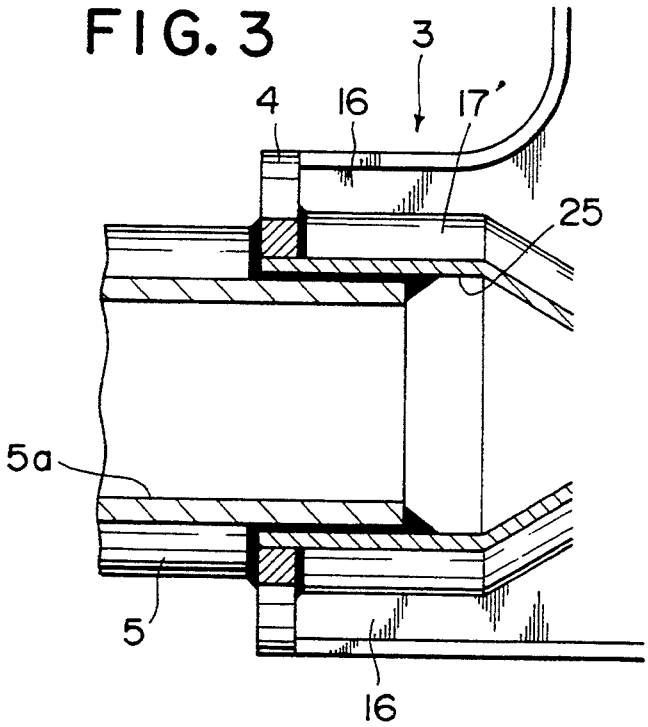
FIG. 3 is a side view, partially in section, of the heat exchanger in the vicinity of the inlet/outlet unit.

FIG. 2 and FIG. 3 show the detailed structures of inlet/outlet unit 3 and its surroundings.

The inlet/outlet unit 3 protrudes from one side of a tank 18. As mentioned above, the unit 3 is formed by joining the parts 17, 17' of the barrel-shaped element of the first and second molded plates 10*b*, 10*b'*. An inserting unit 5*a* of an inlet/outlet pipe 5 is inserted into a circular opening of an insertion hole 25 of the inlet/outlet unit 3.

The seam 16 along which soldering is performed to join the parts 17, 17' of the barrel-shaped element is located outwardly of the unit 3. The seam 16 is spaced by a specific distance from the end of the unit 3, and a ring 4 is placed on the inlet/outlet unit 3 at the end thereof that is free of the seam 16. The ring 4 is made of, e.g. a bare material, such as aluminum, or a blazing sheet, and has a thickness of 1–2 mm.

The ring is positioned by being brought into contact with the front end of the fringes defining the soldering seam 16.

In the process of constructing this heat exchanger, the first and the second tubular elements 1*a*, 1*b* are stacked with the fins interposed between them, and with the second tubular elements 1*b*, 1*b* being located at designated positions. After the stack is pressed by a certain amount of pressure exerted in the direction in which the elements 1*a*, 1*b* are stacked, the rings 4 are placed on the inlet/outlet units 3. Subsequently, the stack is compressed to a certain degree in the direction in which the elements are stacked, and a crank is placed over the stack surrounding the tubular elements to maintain the stack under this condition. Then, the stack is soldered in a furnace. Accordingly, the rings 4 are soldered to the front ends of inlet/outlet units 3. Upon completion of the soldering in the furnace, the inlet/outlet pipes 5 are attached. In attaching the inlet/outlet pipes 5, the inlet/outlet pipes 5 are first inserted in the inlet/outlet units 3, and the inlet/outlet pipes 5 and inlet/outlet units 3 are soldered by torch blazing.

When an inlet/outlet pipe 5 is inserted in an inlet/outlet unit 3 on which a ring 4 is mounted, the inlet/outlet unit 3 receives a force from the inlet/outlet pipe 5 tending to expand the unit outwardly. However, because of the ring 4, the inlet/outlet unit 3 remains circular without being deformed, and there is no gap created between the inlet/outlet unit 3 and the inlet/outlet pipe 5.

Accordingly, when the torch blazing is conducted under this condition, the inlet/outlet unit 3 and inlet/outlet pipe 5 are soldered without a gap being left between them. As a result, no fluid will leak between the inlet/outlet unit 3 and the inlet/outlet pipe 5, whereby the present invention is highly reliable. When the inlet/outlet pipe 5 is soldered to the inlet/outlet unit 3 by torch blazing, heat as high as about 600 degrees is locally applied to the inlet/outlet unit 3, but the heat is absorbed by the ring 4 so that the inlet/outlet unit 3 will not melt when the inlet/outlet pipe 5 is soldered. In addition, when the torch blazing is conducted, the ring 4 functions to prevent the flame from flaring up to prevent accidentally melting the tank 18.

When the inlet/outlet pipe 5 is soldered by torch blazing, as shown in FIG. 3, the solder flows in between the inlet/outlet pipe 5 and the inlet/outlet unit 3, and between the ring 4 and inlet/outlet unit 3 as well, so even if the soldering of the ring 4 is incomplete after the soldering is carried out in the furnace, it can be completed by the process of torch blazing. Therefore, the possibility of the ring 4 being defectively soldered is low, whereby it is ensured that the ring will impart rigidity to the inlet/outlet unit 3. Accordingly, it is not necessary to question the quality of the soldering of the ring 4, and as mentioned earlier, the ring 4 can be made of a bare material or a blazing sheet.

Further embodiments of the present invention will be described below with reference to FIG. 4 through FIG. 15. The same reference numbers are employed for the same components in FIG. 1, and a detailed description of like components will be omitted.

Figure 4:
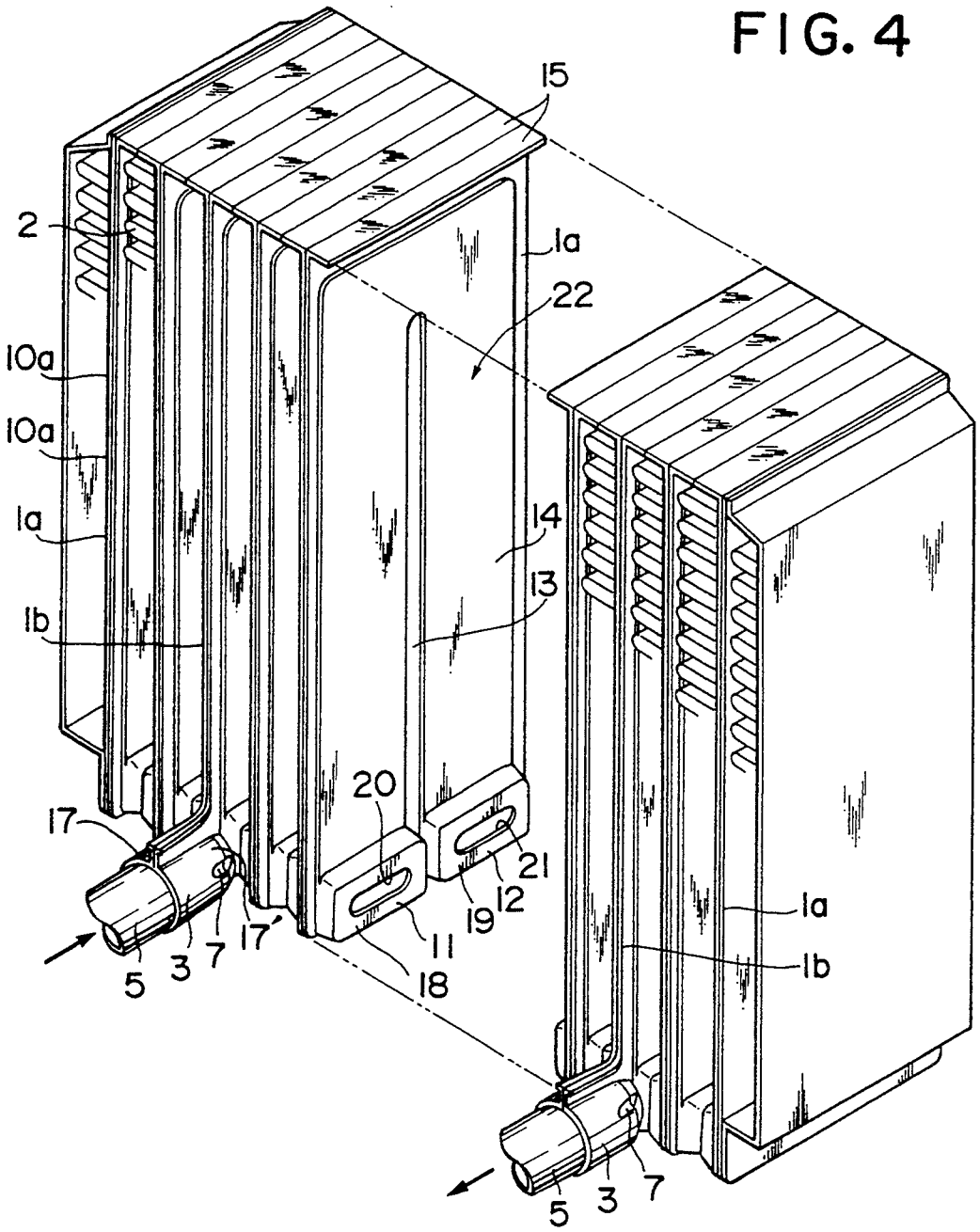
FIG. 4 is a perspective view of a second preferred embodiment of the heat exchanger according to the present invention.
Figure 5:
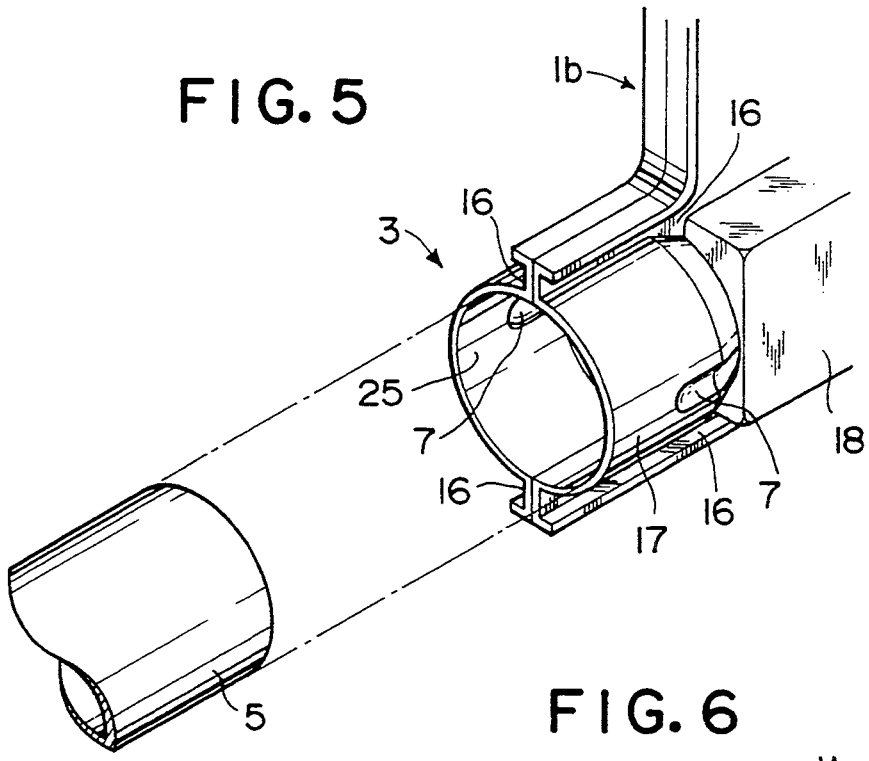
FIG. 5 is an exploded view of the inlet/outlet unit of the second preferred embodiment.
Figure 6:
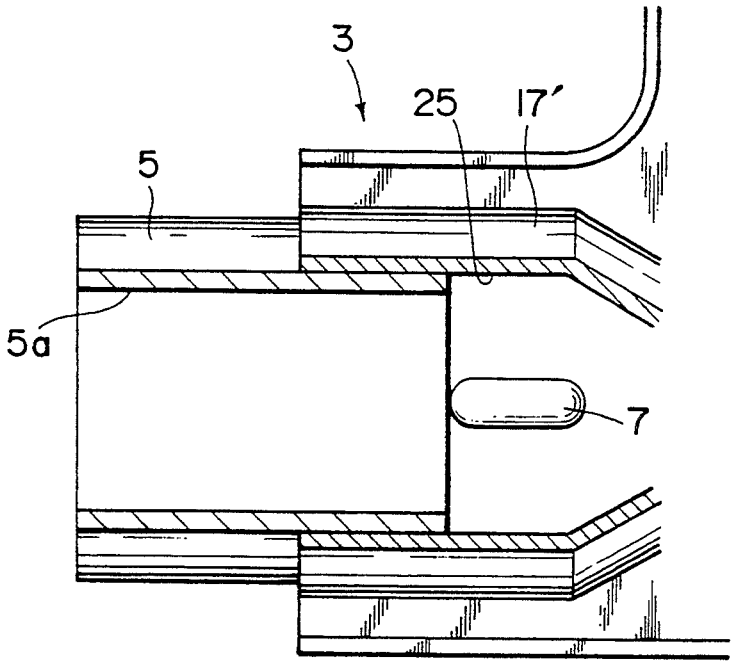
FIG. 6 is a side view, partially in section, of the second preferred embodiment of the heat exchanger in the vicinity of the inlet/outlet unit.

In the preferred embodiment of FIG. 4 through FIG. 6, horizontal protrusions 7 are formed on the sides of the barrel-shaped element by making indentations in the bowl-shaped parts 17, 17' forming the barrel-shaped element. These protrusions 7 are located at diametrically opposite positions on the sides of the inlet/outlet unit 3, when the second and third molded plates 10*b*, 10*b'* have been joined by butt fusion to join the bowl-shaped parts 17, 17' and form the second tubular element 1*b*. In FIG. 5, two protrusions 7 are shown but the present invention is not limited to two protrusions for each barrel-shaped element.

When the inlet/outlet pipe 5 is mounted to the inlet/outlet unit 3, the inlet/outlet pipe 5 is directly inserted into the inlet/outlet unit 3 until it contacts the protrusions 7, whereupon the inlet/outlet pipe 5 and inlet/outlet unit 3 are secured to each other by torch blazing or argon soldering.

Figure 16:
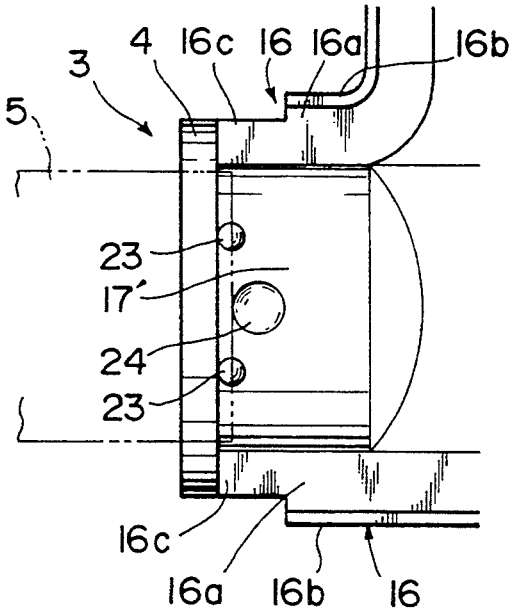
FIG. 16 is a side view of another inlet/outlet unit which can be used in the fourth preferred embodiment of the heat exchanger.
Figure 17:
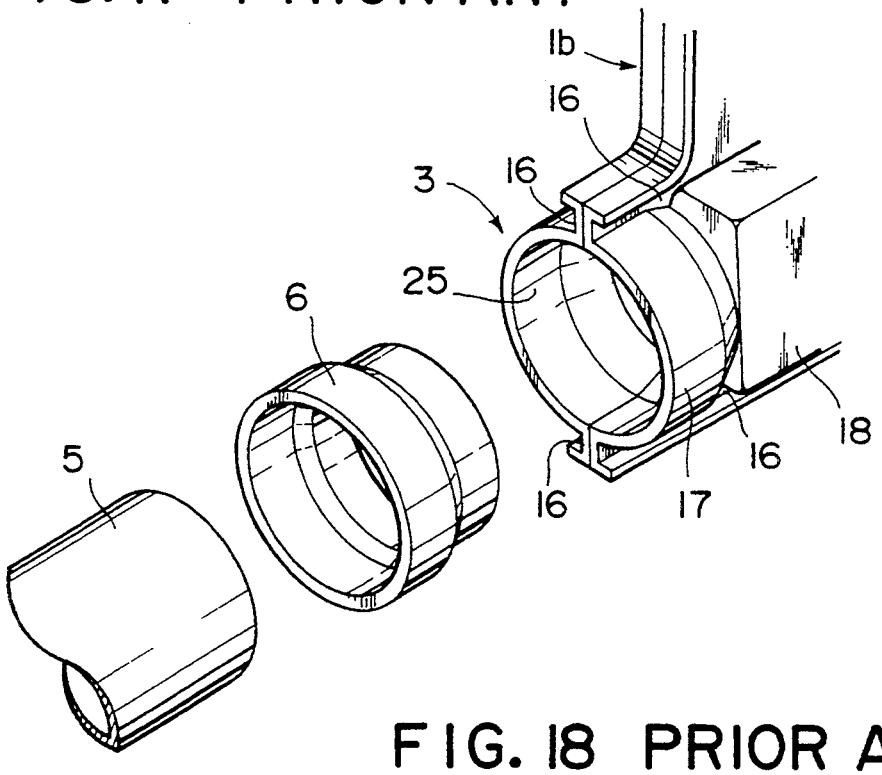
FIG. 17 PRIOR ART
FIG. 17 is an exploded view of the inlet/outlet unit of a conventional heat exchanger.
Figure 18:
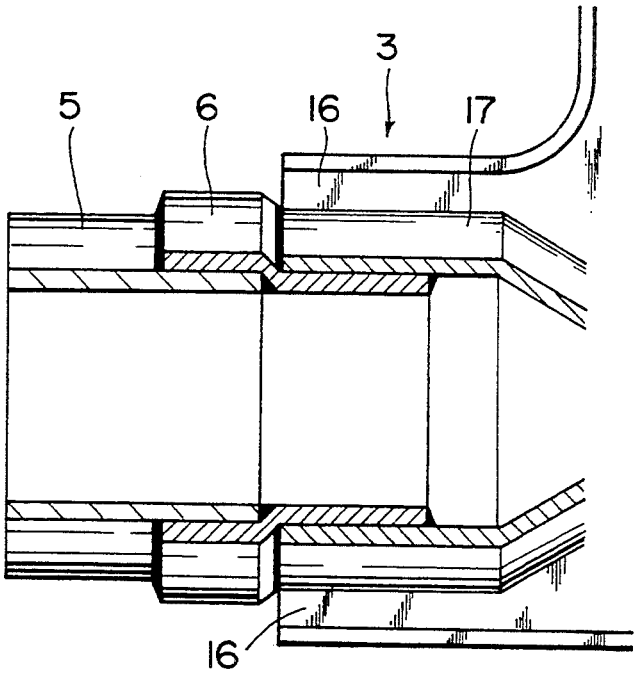
FIG. 18 PRIOR ART
FIG. 18 is a side view, partially in section, of the inlet/outlet unit of the conventional heat exchanger.

Accordingly, the spacer 6 soldered to the inlet/outlet unit 3 in the furnace shown in FIG. 16 and FIG. 17 is unnecessary.

Because the inlet/outlet pipe 5 has only to be inserted in the inlet/outlet unit 3 until it reaches the protrusions 7, it is easy to judge how far the inlet/outlet pipe 5 should be inserted, and to position the pipe. Further, because the wall of the inlet/outlet unit 3 is partially indented, the rigidity of the inlet/outlet unit 3 is enhanced, i.e. the inlet/outlet unit is reinforced.

Figure 7:
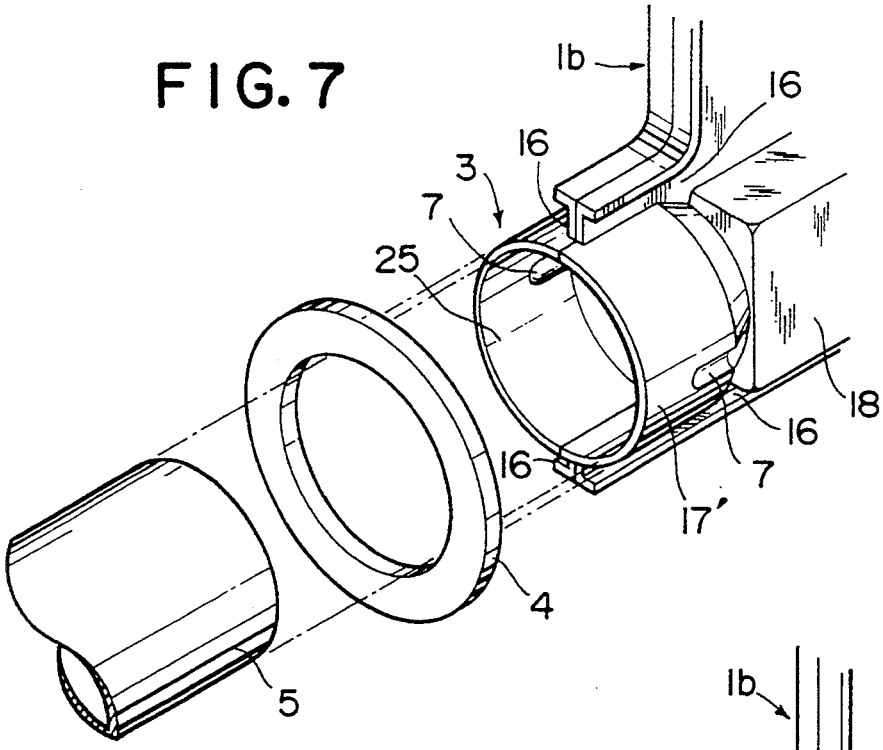
FIG. 7 is an exploded view of another inlet/outlet unit which can be used in the second preferred embodiment of the heat exchanger.

In the preferred embodiment of FIG. 7, fringes extending radially outwardly from the inlet/outlet unit 3, and defining the soldering seams 16 therebetween, have been cut off from an area at the end of the inlet/outlet unit 3 so that the ring 4 can be put on the inlet/outlet unit 3.

Therefore, even though the inlet/outlet unit 3 receives a force from the inlet/outlet pipe 5 inserted in the inlet/outlet unit 3, that tends to expand the inlet/outlet unit 3 outwardly, the ring 4 in addition to the protrusions 7 prevents the deformation of inlet/outlet unit 3. Therefore, the circular form of the inlet/outlet unit 3 will be preserved ensuring an airtight sealing between the inlet/outlet pipe 5 and the inlet/outlet unit 3.

Figure 8:
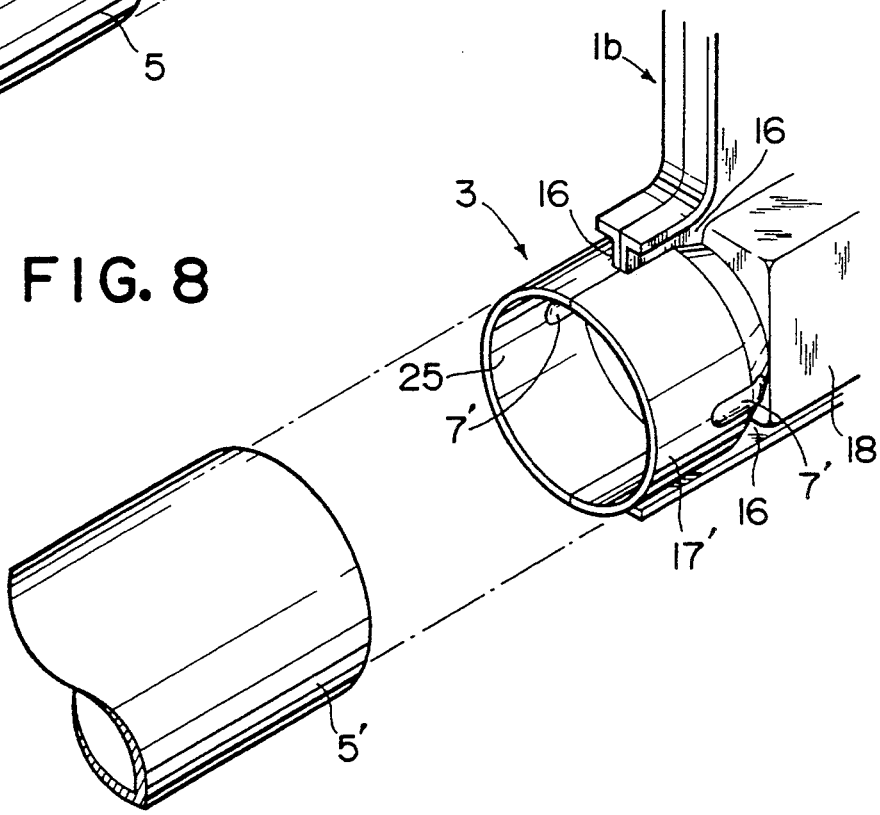
FIG. 8 is an exploded view of still another inlet/outlet unit which can be used in the second preferred embodiment of the heat exchanger.
Figure 9:
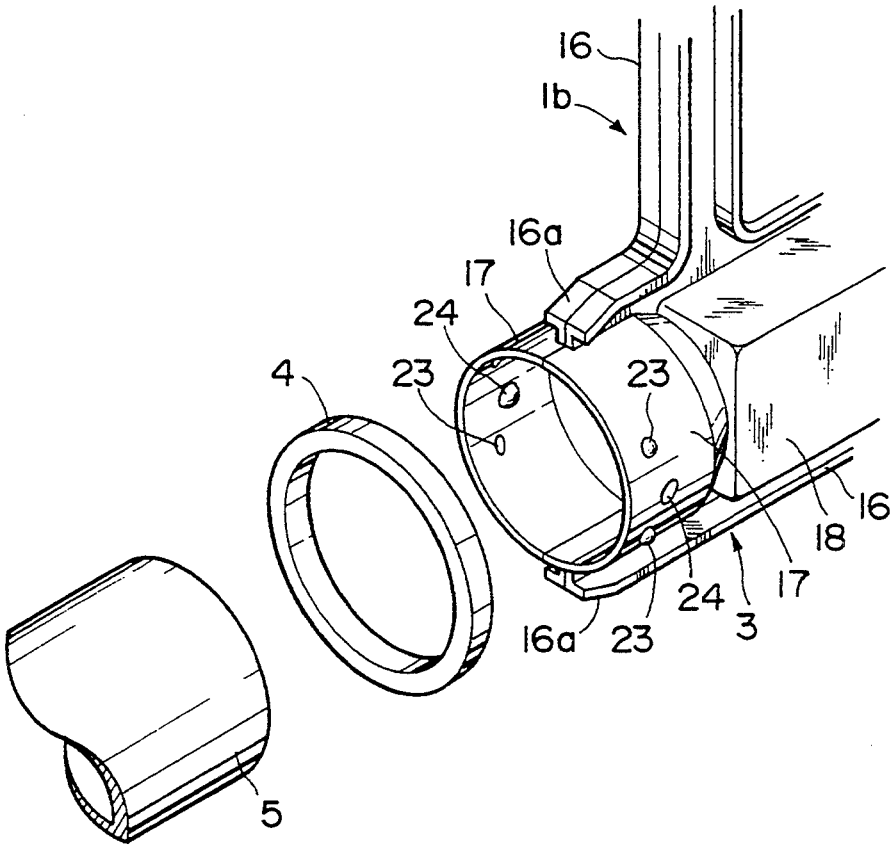
FIG. 9 is an exploded view of an inlet/outlet unit of a third preferred embodiment of the heat exchanger according to the present invention.
Figure 10:
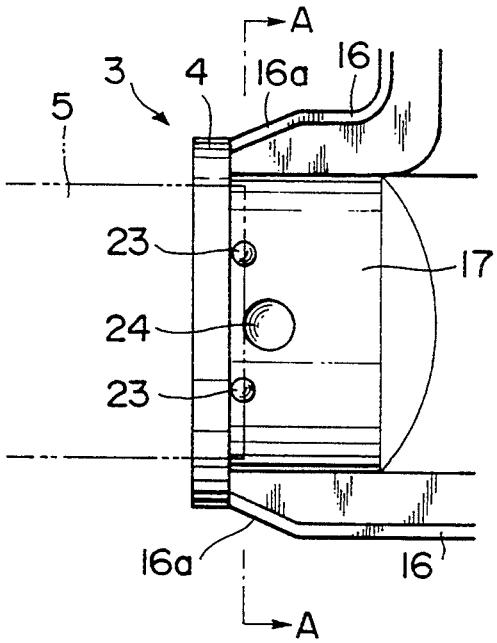
FIG. 10 is a side view of a portion of the third embodiment of the heat exchanger.
Figure 11:
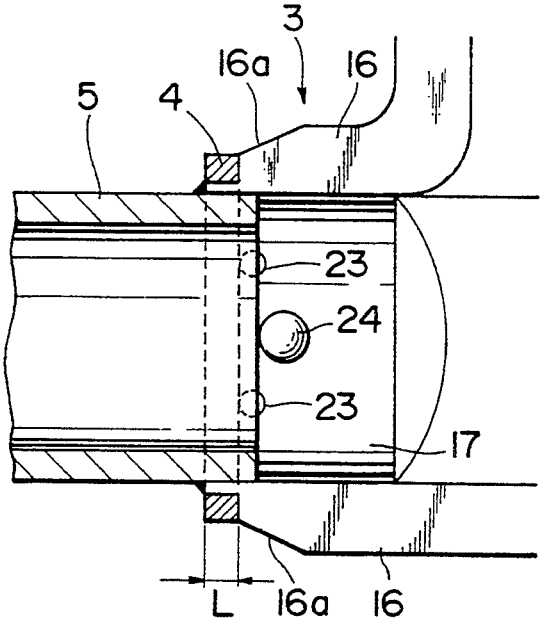
FIG. 11 is a side view, partially in section, of the third embodiment of the heat exchanger in the vicinity of the inlet/outlet unit.
Figure 12:
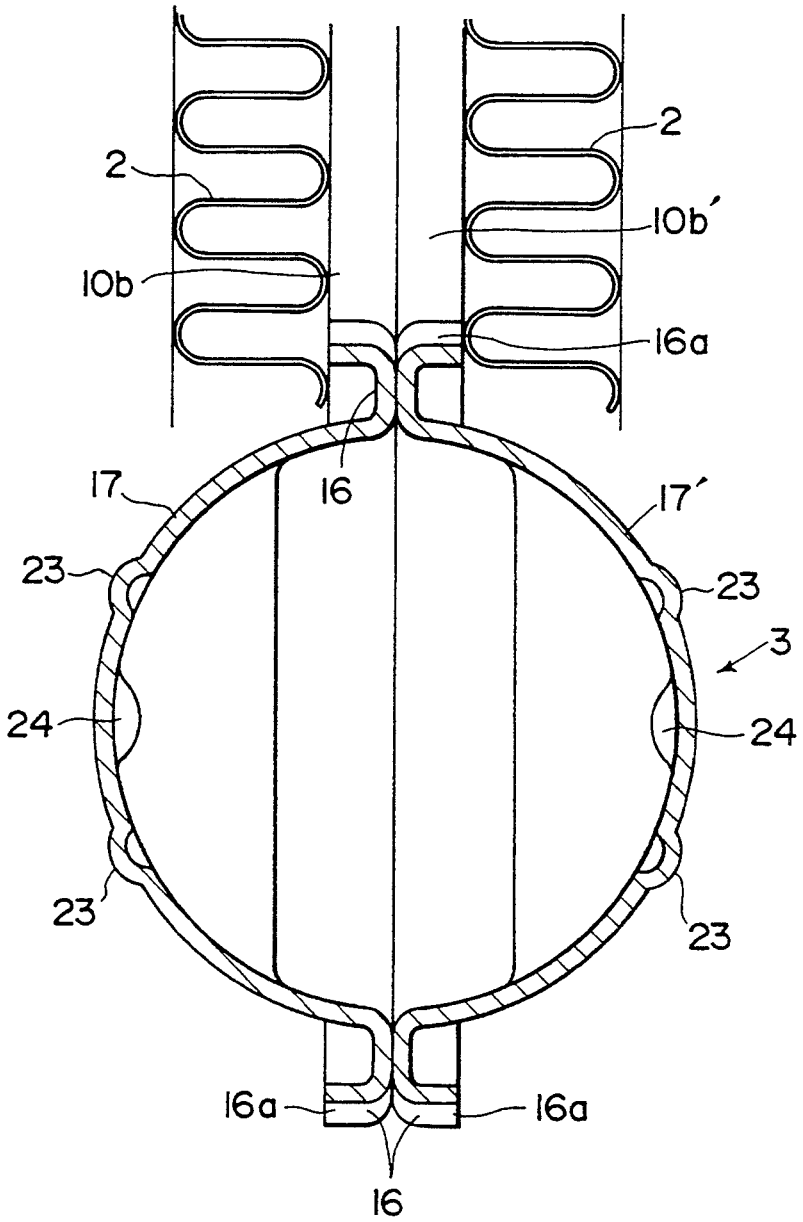
FIG. 12 is a sectional view of the third embodiment of the heat exchanger as taken along line A—A in FIG. 10.

In the preferred embodiment of FIG. 8, the fringes defining soldering seam 16 are spaced from the end of the inlet/outlet unit 3 by a distance equal to that at which the protrusions 7 are so spaced such that the inlet/outlet pipe 5' can be mounted over the barrel-shaped element in contact with the protrusions 7'.

More specifically, the protrusions 7' of the barrel-shaped element are formed by expanding side walls of the parts 17, 17' of the barrel-shaped element outwardly. This constitution also contributes to reinforcing (imparting rigidity to) the inlet/outlet unit 3 and to reducing the manufacturing cost of the heat exchanger.

In the preferred embodiment shown in FIG. 9 through FIG. 12, fringes of the plates **10*b*, 10*b'* defining the soldering seam 16 on the inlet/outlet unit 3 are cut and removed from the end of the inlet/outlet unit 3 over a distance corresponding to the axial length (L) of the ring 4. The front ends of the fringes are tapered at 16*a* with the length of the fringes as taken from the surfaces of the barrel-shaped element becoming shorter toward the end of the barrel-shaped element. The length of each of the fringes (radial dimension) at the end thereof is equal to or less than the thickness of the ring 4** in its radial direction.

The parts 17, 17' of the barrel-shaped element have protrusions 23 which have been formed at the same time when the molded plates have been formed by a press. In this preferred embodiment, the protrusions 23 are hemispherical and protrude from the outer surfaces of the parts 17, 17'. Each of the parts 17, 17' of the barrel-shaped element has two protrusions 23 spaced desired distances from each other and from the soldering seams 16, respectively. The distance from each protrusion 23 to the end of the barrel-shaped element is equal to the distance by which the terminal ends of the soldering seam 16 is spaced from the end of the barrel-shaped element so that the ring 4, when positioned on the inlet/outlet unit 3, contacts the ends of the fringes defining the soldering seam 16 as well as the protrusions 23.

Hemispherical indentations 24 are also press-formed in the parts 17, 17' of the barrel-shaped element so as to protrude radially inwardly. In this preferred embodiment, the indentation 24 is formed between the protrusions 23, 23 to help position the inlet/outlet pipe 5 when the inlet/outlet pipe 5 is inserted in the inlet/outlet unit 3.

Because the ring 4 contacts and is secured to the fringes defining soldering seam 16 and the protrusions 23 when the soldering in the furnace has been completed, the ring 4 cannot be tilted during the subsequent process of inserting the inlet/outlet pip into the inlet/-outlet unit 3 and soldering them by torch blazing.

As a result, the inlet/outlet unit 3 and the inlet/outlet pipe 5 do not allow the solder joining the ring 4 and the inlet/outlet unit 3 to flow out, whereby the heat exchanger of the present invention is highly reliable.

In addition, because the end portions of the fringes are tapered such that the ends of the fringes do not protrude beyond the outer periphery of the ring 4, the soldering seam 16 is protected from being directly contacted by the flame and the fringes are thus prevented from being melted at the time of torch blazing.

In this preferred embodiment, two protrusions 23 that position the ring 4 are formed on each part 17, 17' of the barrel-shaped element but one or any number of protrusions can be employed to prevent the ring 4 from being tilted.

Figure 13:
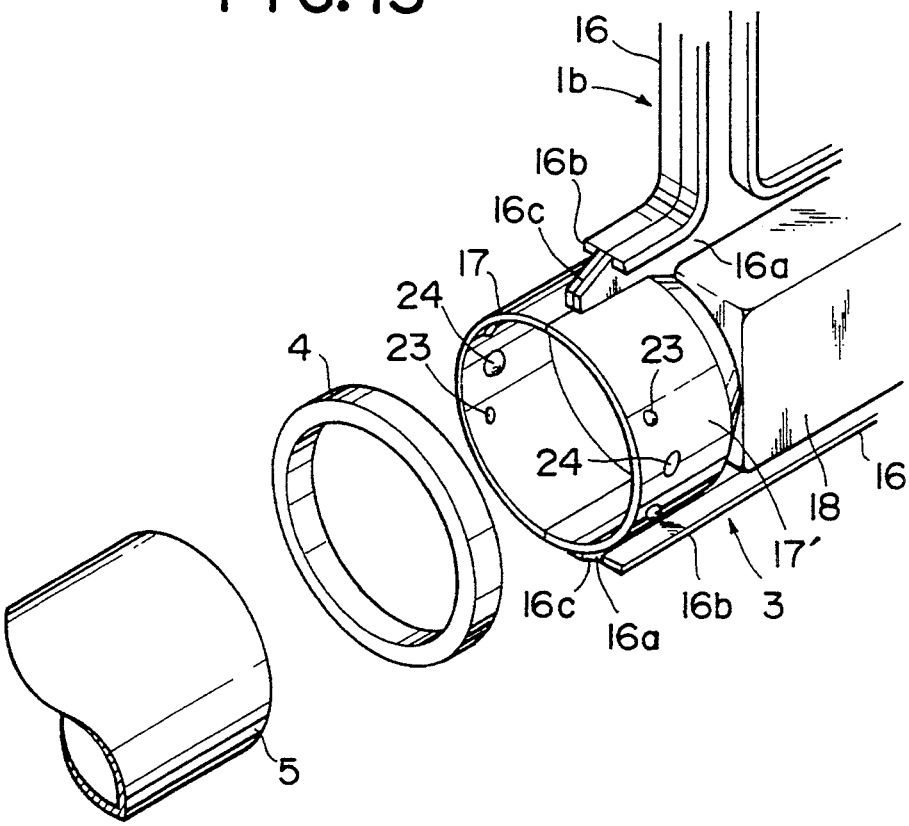
FIG. 13 is an exploded view of an inlet/outlet unit of a fourth preferred embodiment of the heat exchanger according to the present invention.
Figure 14:
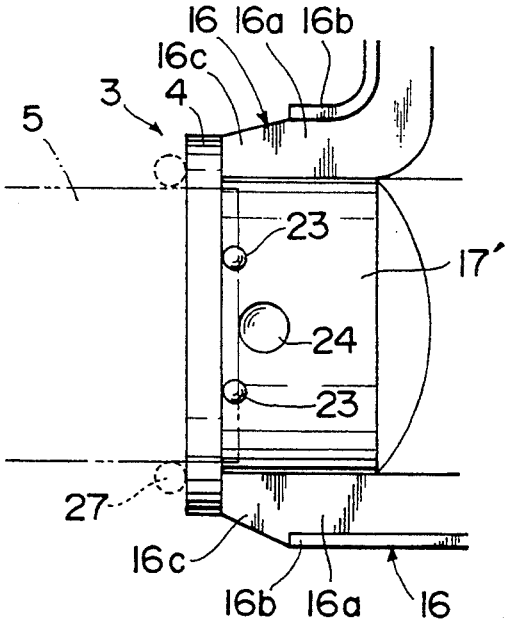
FIG. 14 is a side view of the inlet/outlet unit of the fourth preferred embodiment.
Figure 15:
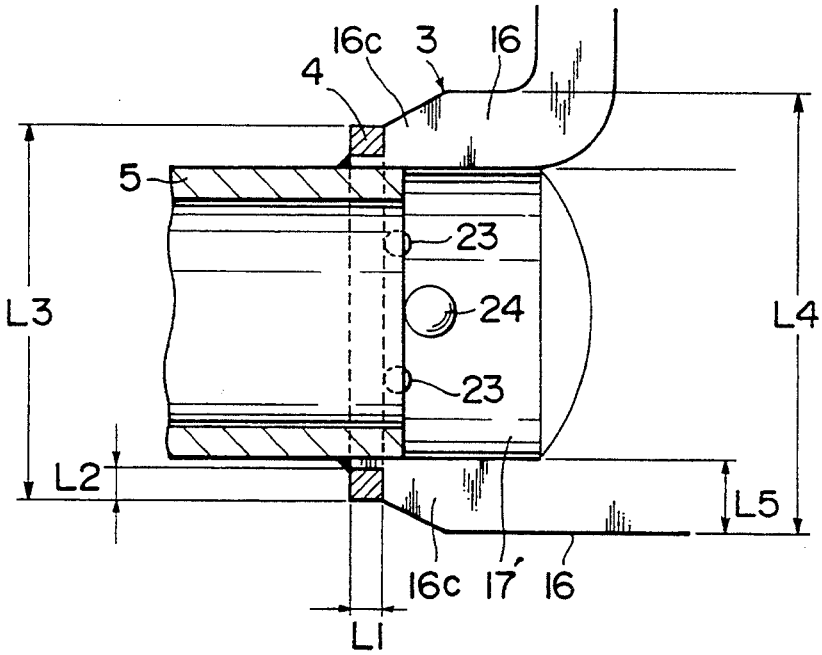
FIG. 15 is a side view, partially in section, of the inlet/outlet unit of the fourth preferred embodiment.

In the preferred embodiment shown in FIG. 13 and FIG. 15, each fringe includes a jointing portion **16*a* protruding from the surface of the barrel-shaped element where the parts 17, 17' thereof are joined, and a flange 16*b* bent from the edge of the joining portion 16*a*. The soldering seam 16 terminates at a location on the inlet/outlet unit 3 spaced from the end of unit 3 by a distance corresponding to the width of ring 4 (L1). The length (in the radial direction) of the fringe at the end of the tapered part 16*c* thereof is equal to or less than the thickness (L2) of the ring 4** in its radial direction.

The outer diameter (L3) of the ring 4 is smaller than the width (L4) taken between the upper and bottom fringes at portions **16*a*; in other words, the thickness of the ring 4 in its radial direction (L2) is smaller than the length (L5) as shown in FIG. 15**.

Accordingly, the fringes do not protrude radially outwardly of the ring 4 at their area of contact, which in turn prevents the soldering seams 16 from being directly contacted by the flame during torch blazing and from being melted. In addition, this also prevents the solder, which has been applied to the soldering seams 16 in the soldering process carried out in the furnace, from being melted and flowing out.

In the preferred embodiment shown in FIG. 16, the flange unit **16*b* is likewise removed at the end portion 16*c* of the fringe but the joining portion 16*a* of the fringe protrudes radially outwardly from the barrel-shaped element a distance equal to or less than the thickness of the ring 4** in its radial direction.

The above-described heat exchanger thus not only possesses the same advantages as the other preferred embodiments but also withstands torch blazing better than the aforementioned embodiments due to the fact that the joining portion **16*a*** is cut off at the end portion of the fringe. Therefore, the inlet/outlet units will not be damaged when the soldering seams are heated, and the sealing of the joint is sufficient to prevent fluid from leaking therefrom.

The present invention has been described in connection with a so-called one side-tank type of heat exchanger, wherein the tanks are all located on one end of the heat exchanger. However, the present invention is applicable to a two side-tank type of heat exchanger having tanks at the opposing ends thereof.

It goes without saying that many variations and modifications to the aforementioned embodiment will become apparent to those of ordinary skill in the art. Therefore, the invention can be implemented in forms other than those specifically described in the specification. However, all such variations and modifications of the present invention are seen to be within the true spirit and scope of the present invention as defined by the appended claims.

We claim:

1. A heat-exchanger comprising:

a plurality of tubular elements stacked one upon the other, each of said tubular elements including two plates joined together at a seam running therebetween, said plates having passage-forming protrusions defining a passage between said plates, and said plates having tank-forming protrusions defining a pair of tanks, said tanks being connected by said passage, the tank-forming protrusions of said plates being aligned in respective rows in the direction in which the tubular elements are stacked, and respective ones of the tanks defined by said tank-forming protrusions in each said row being open to each other;

fins interposed between adjacent ones of said tubular elements and contacting the passage-forming protrusions of the plates of said tubular elements;

inlet/outlet units each comprising a barrel-shaped element protruding from and open to one of the tanks of a respective one of said tubular elements, the barrel-shaped element including respective parts of the plates of said respective one of said tubular elements such that said parts of the barrel-shaped element are located on opposite sides of the seam running between the plates;

inlet/outlet pipes fitted coaxially in contact with and joined to the barrel-shaped elements, respectively; and reinforcing means for preventing the parts of said barrel-shaped elements from being deformed as the inlet/outlet pipes are fitted to said barrel-shaped elements during the assembly of the heat exchanger, whereby the inlet/outlet pipes remain in contact with the barrel-shaped elements of the inlet/outlet units, respectively, after the plates of each said respective one of said tubular elements have been joined together along the seam running between the plates thereof.

2. A heat exchanger as claimed in claim 1, wherein said seam, at which the plates of said respective one of the tubular elements are joined, terminates at a location spaced a predetermined distance from an end of the barrel-shaped element protruding from the tank of the respective one of the tubular elements, said reinforcing means includes a ring disposed around the barrel-shaped element adjacent said end thereof, and the inlet/outlet pipe fitted in contact with the barrel-shaped element.

3. A heat exchanger as claimed in claim 2, wherein the ring has a thickness in the axial direction thereof equal to said predetermined distance such that the ring extends axially from the end of the barrel-shaped element to the terminal end of the seam.

4. A heat exchanger as claimed in claim 2, wherein said plates of said respective one of the tubular elements have fringes which each extend radially outwardly a second predetermined distance from said parts of the barrel-shaped element, respectively, the fringes of said plates abutting each other and said seam being located therebetween, and wherein said ring has a width in the radial direction thereof that is at least equal to said second predetermined distance.

5. A heat exchanger as claimed in claim 2, wherein said barrel-shaped element has protrusions extending radially outwardly from said parts of the barrel-shaped element at locations spaced from the end of said barrel-shaped element by respective distances each equal to said predetermined distance, and said ring is positioned against said protrusions.

6. A heat exchanger as claimed in claim 1, wherein each said pair of the tanks of a tubular element is located at one end of the tubular element, and said passage connecting the tanks of each said pair thereof is U-shaped.

7. A heat exchanger as claimed in claim 1, wherein said reinforcing means includes at least one protrusion extending from the parts of a said barrel-shaped element and contacting the inlet/outlet pipe fitted to the barrel-shaped element, the at least one protrusion having limited the extent to which the inlet/outlet pipe was moved axially relative to the barrel-shaped element during the assembly of the heat exchanger.

8. A heat exchanger as claimed in claim 7, wherein said at least one protrusion protrudes radially inwardly from the parts of said barrel-shaped element, and an end of a said inlet/outlet pipe is disposed within said barrel-shaped element and in contact with each said at least one protrusion.

9. A heat exchanger as claimed in claim 7, wherein said at least one protrusion protrudes radially outwardly from the parts of said barrel-shaped element, and an end of said inlet/out pipe is disposed around said barrel-shaped element and in contact with each said at least one protrusion.

10. A heat exchanger as claimed in claim 7, wherein said at least one protrusion comprises two protrusions located at diametrically opposite positions on the barrel-shaped element.

11. A heat exchanger as claimed in claim 7, wherein said protrusion is elongate in the axial direction of the barrel-shaped element.

12. A heat exchanger as claimed in claim 7, wherein said seam, at which the plates of said respective one of the tubular elements are joined, terminates at a location spaced a predetermined distance from an end of the barrel-shaped element protruding from the tank of the respective one of the tubular elements, said reinforcing means further includes a ring disposed around the barrel-shaped element adjacent said end thereof, and the inlet/outlet pipe fitted in contact with the barrel-shaped element has an end disposed within the barrel-shaped element.

13. A heat exchanger as claimed in claim 12, wherein each said barrel-shaped element has second protrusions extending radially outwardly from said parts of the barrel-shaped element at locations spaced from the end of said barrel-shaped element by respective distances each equal to said predetermined distance, and said ring is positioned against said second protrusions.

14. A heat exchanger as claimed in claim 7, wherein each said pair of the tanks of a tubular element is located at one end of the tubular element, and said passage connecting the tanks of each said pair thereof is U-shaped.

* * * * *